US008266815B2

(12) United States Patent
Goldberg et al.

(10) Patent No.: US 8,266,815 B2
(45) Date of Patent: Sep. 18, 2012

(54) CLEANING DEVICE FOR A COMPONENT WITHIN A PROCESS AIR CIRCUIT OF A HOUSEHOLD TUMBLE-DRYER

(75) Inventors: Roman Goldberg, Dresden (DE); Klaus Grunert, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1054 days.

(21) Appl. No.: 12/223,345

(22) PCT Filed: Jan. 11, 2007

(86) PCT No.: PCT/EP2007/050239

§ 371 (c)(1),
(2), (4) Date: Jul. 29, 2008

(87) PCT Pub. No.: WO2007/093468

PCT Pub. Date: Aug. 23, 2007

(65) Prior Publication Data

US 2009/0031513 A1 Feb. 5, 2009

(30) Foreign Application Priority Data

Feb. 17, 2006 (DE) ..... 10 2006 007 420

(51) Int. Cl.
*F26B 19/00* (2006.01)
*F28G 3/04* (2006.01)
*F28G 9/00* (2006.01)

(52) U.S. Cl. ..... 34/90; 15/104.04; 15/246; 15/88.4; 165/95

(58) Field of Classification Search ..... 15/88.4, 15/88, 104.04, 246, 256.5, 256.52, 256.51; 165/95; 34/139, 85, 90
See application file for complete search history.

(56) References Cited

U.S. PATENT DOCUMENTS

| | | | | | |
|---|---|---|---|---|---|
| 1,340,020 | A | * | 5/1920 | Corcoran | 15/3.12 |
| 1,985,156 | A | * | 12/1934 | Fieldhouse | 165/84 |
| 2,399,555 | A | | 4/1946 | Locke | |
| 2,627,669 | A | * | 2/1953 | Candor | 34/547 |
| 2,854,086 | A | * | 9/1958 | Schmidt | 180/68.6 |
| 3,883,292 | A | * | 5/1975 | Hamaker | 432/60 |
| 4,621,438 | A | * | 11/1986 | Lanciaux | 34/77 |
| 5,211,028 | A | * | 5/1993 | Remo | 62/303 |
| 6,041,612 | A | * | 3/2000 | Stringer | 62/303 |

(Continued)

FOREIGN PATENT DOCUMENTS

DE 3120376 A1 * 12/1982

(Continued)

OTHER PUBLICATIONS

International Search Report PCT/EP2007/050239.

*Primary Examiner* — Joseph J Hail
*Assistant Examiner* — Tyrone V Hall, Jr.
(74) *Attorney, Agent, or Firm* — James E. Howard; Andre Pallapies

(57) ABSTRACT

A cleaning device for a component, especially a heat exchanger, operatively disposed within a process air circuit of a household tumble dryer, the cleaning device comprising a rotatable brush device for removal of lint deposits from the component; a linear drive mechanism for driving the brush device along the component; and a rotary drive mechanism for driving the brush device about an axis of rotation.

19 Claims, 2 Drawing Sheets

U.S. PATENT DOCUMENTS

| | | | | |
|---|---|---|---|---|
| 2003/0053024 | A1 * | 3/2003 | Lee | 349/187 |
| 2010/0319146 | A1 * | 12/2010 | Goldberg et al. | 15/40 |

FOREIGN PATENT DOCUMENTS

| | | | | |
|---|---|---|---|---|
| DE | 82 24 528 | U | | 2/1983 |
| DE | 32 24 948 | | | 12/1983 |
| DE | 37 38 031 | | | 5/1989 |
| DE | 3738031 | A1 | * | 5/1989 |
| DE | 94 13 742 | U | | 12/1994 |
| DE | 44 03 183 | | | 8/1995 |
| DE | 100 02 743 | | | 8/2001 |
| DE | 101 16 238 | | | 1/2003 |
| EP | 0 468 573 | | | 1/1992 |
| GB | 2087029 | A | * | 5/1982 |
| GB | 2115126 | A | * | 9/1983 |
| GB | 2 360 471 | | | 9/2001 |
| JP | 60-53199 | | | 3/1985 |
| JP | 7-136396 | | | 5/1995 |

* cited by examiner

CLEANING DEVICE FOR A COMPONENT WITHIN A PROCESS AIR CIRCUIT OF A HOUSEHOLD TUMBLE-DRYER

BACKGROUND OF THE INVENTION

The invention relates to a cleaning device for a component arranged within a process air circuit of a household tumble dryer, especially for a heat exchanger, of the type described herein.

Such a cleaning device is already to be taken as known from EP 0 468 573 A1, in which a heat exchanger embodied as a working medium evaporator is arranged within a process air circuit of a heat pump tumble dryer. In this case the cleaning device includes a brush device with a flat brush that can be moved back and forth by means of an electric motor and a crank across the face of the heat exchanger. This is designed to remove from the fins of said device the lint accumulating on the fins of the heat exchanger, which is transported by the hot, moist process air and on cooling down comes into contact with the working medium evaporator.

The disadvantage of this known cleaning device is however the fact that the flat brush can only reliably remove the lint from the fins of the heat exchanger from the front side of the heat exchanger over a restricted depth. In addition the lint captured by the bristles and removed from the heat exchanger adheres to the bristles relatively easily, which enormously degrades the cleaning result —especially when the flat brush has been idle for some time.

BRIEF SUMMARY OF THE INVENTION

The object of the present invention is thus to create a cleaning device of the type mentioned above with which the component arranged within the stream of process air can be cleaned to a greater depth and in which the captured lint is able to be removed from the brush device.

In accordance with the invention this object is achieved by a cleaning device with the features described herein. Advantageous embodiments with useful and non-trivial developments of the invention are described.

In the inventive cleaning device the brush device comprises at least one round brush which is able to be rotated around an axis of rotation by means of a rotary drive. With a round brush of this type the bristles or similar can be moved at a relatively high speed of rotation, so that these—by contrast with bristles of a flat brush—can penetrate very much deeper into the relevant component. In this case especially the lint deposited relatively deeply within the component can be transported reliably to the surface and then away from the component, so that a significantly better overall cleaning result can be implemented. The rotational movement of the round brush also ensures that the lint detached from the component does not adhere to the bristles or similar and thus remain within the round brush, but instead is transported outwards because of the centrifugal force as the round brush rotates. This avoids adhesion and a diminution of the cleaning effect over time.

It has also been shown to be advantageous to use the round brush in a heat exchanger embodied as a working medium evaporator or as a condensation device. The condensate deposited in the area of the fins, heat exchanger plates or similar causes relatively large amounts of lint to adhere to such heat exchangers, which can lead both to a reduced cooling power and also to a loss within the process air circuit.

It has also proved advantageous to be able to move the round brush at least approximately along the entire face of the heat exchanger. This makes an even cleaning possible over the entire surface of the heat exchanger over which air flows, which enables a uniform cooling power to be implemented over all fins, heat exchanger plates or similar.

In a further embodiment of the invention it has been shown to be advantageous to design the direction of rotation of the rotating brush to be adjustable as a function of its translational direction of movement. This makes it possible to select, the direction of rotation of the bristles—depending on the translational movement of the round brush—such that the lint is transported outwards from within the component or the heat exchanger.

It is also advantageous for the bristles or similar of the round brush to be able to penetrate down to the working medium pipes in the working medium evaporator. Experience has shown that a particularly large amount of condensate of the moist, warm air is deposited in the area of the working medium pipes, which also causes large amounts of lint to adhere to the working medium pipes.

The cleaning cycles of the cleaning device can be determined in a simple manner by a specific pressure loss within the process air circuit being measured via a pressure sensor. Such a pressure loss occurs when a certain amount of lint has been deposited on the component over which the process air flows.

In a further embodiment of the invention lint or other contamination can be cleaned off the round brush especially reliably if a comb is provided through which the bristles or suchlike of the rotating round brush are pulled.

An especially good removal of the lint can be achieved if the component and/or the round brush are rinsed with a cleaning fluid. In an especially cost-effective and environmentally-friendly solution the condensate of the working medium evaporator or of the condensation device which is present in any event is used.

Especially with a heat exchanger embodied as a condensation device it has finally been shown to be advantageous for a plurality of fins to be arranged in the direction of flow of the process air circuit before the heat exchanger. This makes it possible to collect the predominant part of the lint or similar contamination in the area of the fins, with the bristles or similar of the round brush preferably being able to penetrate to the far end of the fins into the heat exchanger. This makes an especially intensive and complete cleaning of the heat exchanger possible. If, in addition, the individual fins of the heat exchanger are to be cooled, it is thus ensured that an especially large amount of condensate and thereby also lint is deposited in the area of the easy-to-clean fins.

BRIEF DESCRIPTION OF THE DRAWINGS

Further advantages, features and details of the invention emerge from the subsequent description of a preferred exemplary embodiment as well as with reference to the drawings; these drawings show in.

DETAILED DESCRIPTION OF THE PRESENT INVENTION

Figure 1:
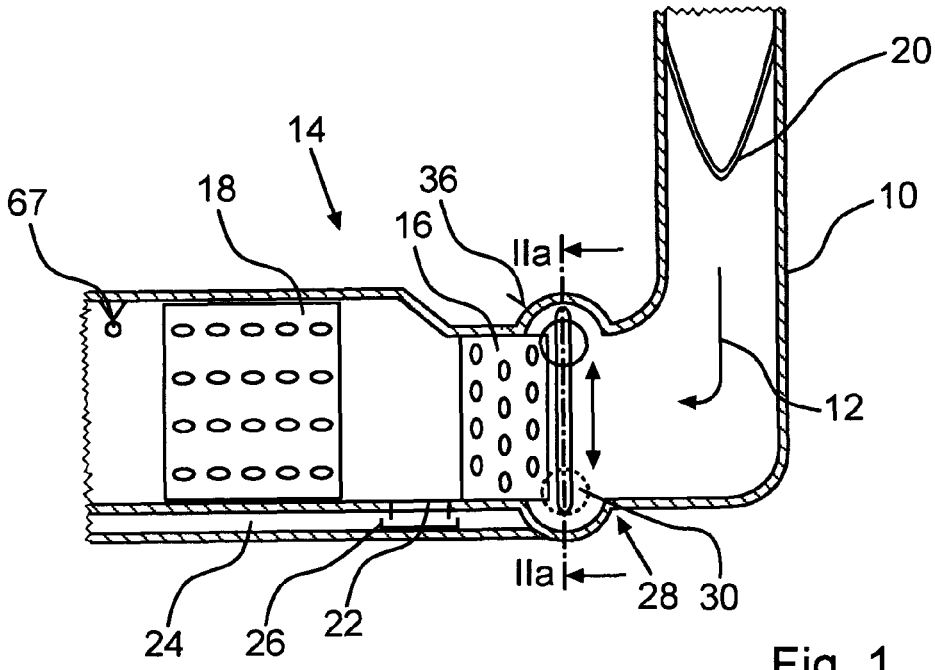
FIG. 1 a schematic side view of a heat exchanger arrangement arranged within a channel of a process air circuit of a household tumble dryer shown in section with a working medium evaporator, on the front of which - viewed in the direction of flow of the process air circuit - a schematic cleaning device can be seen.

FIG. 1 shows a household tumble dryer embodied as a recirculating dryer in section and a section of a channel 10 of a process air circuit, the direction of flow of which is shown by the arrow 12. A heat exchanger arrangement 14 can be seen within the process air circuit, which in the present exemplary embodiment comprises a working medium evaporator 16 and a working medium condenser 18. Arranged in the direction of flow of the process air circuit before the heat exchanger arrangement 14 is a lint filter 20. This lint filter 20 enables a majority of the lint or similar contamination particles to be removed, which are transported via the warm, moist are taken out of the laundry drum of the household tumble dryer not shown in diagram. The separated lint is to be removed in this case from the lint filter 20 in the known manner.

The warm, moist process air in the area of the lint filter 20 is dried out by means of the working medium evaporator 16, with the condensate arising being able to be pumped out via an outlet opening 22 and an outlet line 24 by means a pump not shown. Arranged below the outlet opening 22 is collection tray 26 via which lint or similar contamination particles are collected. The collection tray 26 is accordingly to be emptied manually from time to time. The cool and dry air downstream from the working medium evaporator 16 is subsequently heated up again by the working medium condenser 18 in order to enable the stream of process air to be directed into the laundry drum again by a fan not shown in the figure.

Arranged within the process air circuit in the direction of flow before the working medium evaporator 16 is a cleaning device with a brush device 28, which is used to remove lint or similar contamination which, despite the lint filter 20, has reached the working medium evaporator 16 and has been deposited there.

Figure 2A:
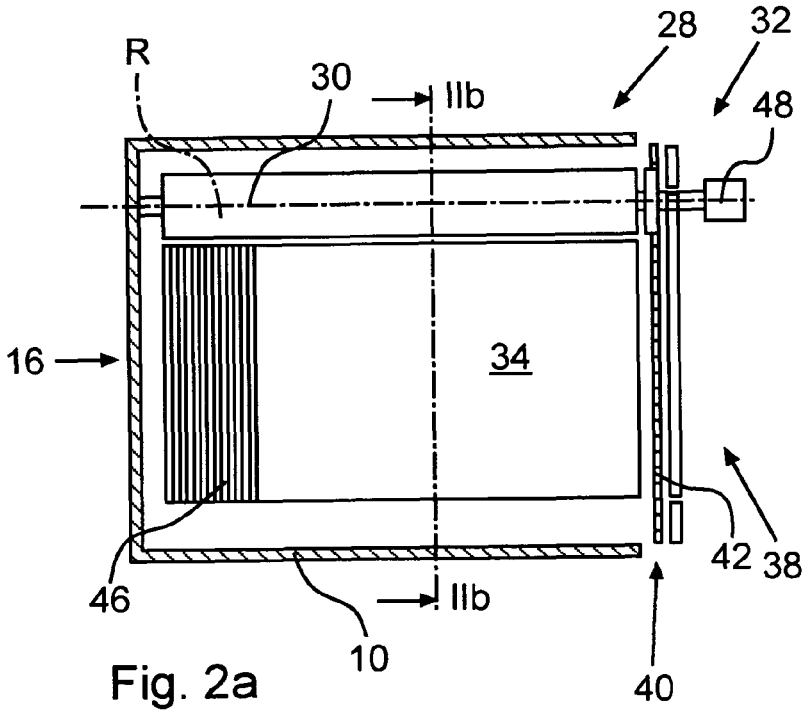
FIG. 2*a* a schematic sectional view through the channel of the process air circuit along the line II a-II a FIG. 1.
Figure 2B:
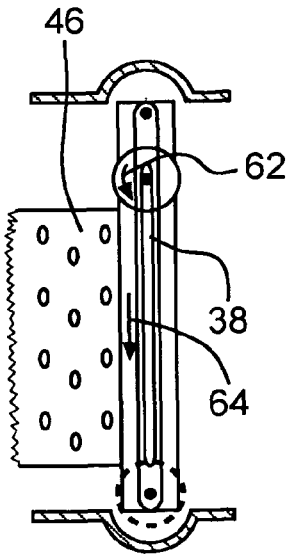
FIG. 2*b* a schematic sectional view through the brush device of the cleaning device arranged in front of the working medium evaporator along the line II b-II b in FIG. 2*a;*

In conjunction with FIGS. 2*a* and 2*b*, which, in a schematic sectional view along the line II a - II a in FIG. 1 or along the line II b-II b in Fig, 2*a*, show the brush device 28 arranged upstream of the working medium evaporator 16, it can be seen that this includes a round brush 30 as a major element. This round brush 30 is driven so that it rotates around an axis of rotation R and comprises a plurality of bristles, small tongues or similar. It is especially evident from FIG. 2*a* that the round brush 30 is to be moved by means of a drive mechanism 32 completely along a front side 34 of the working medium evaporator 16. To make this possible bulges 36 (FIG. 1) are provided within the channel 10 of the process air circuit into which the round brush 30 can penetrate. In other words the round brush 30 can be moved by this method far enough outwards for the front side 34 of the working medium evaporator 16 to be equally well cleaned at every point. The round brush 28 is moved in this case by means of a guiding device 38 of the drive mechanism 32 in a translational movement along the face side 34 of the working medium evaporator 16. To this end the drive mechanism 32 includes a rack and pinion drive 40 especially further able to be seen in conjunction with FIG. 3 with rack 42, along which the round brush 32 is moved in a translational movement.

Figure 3:
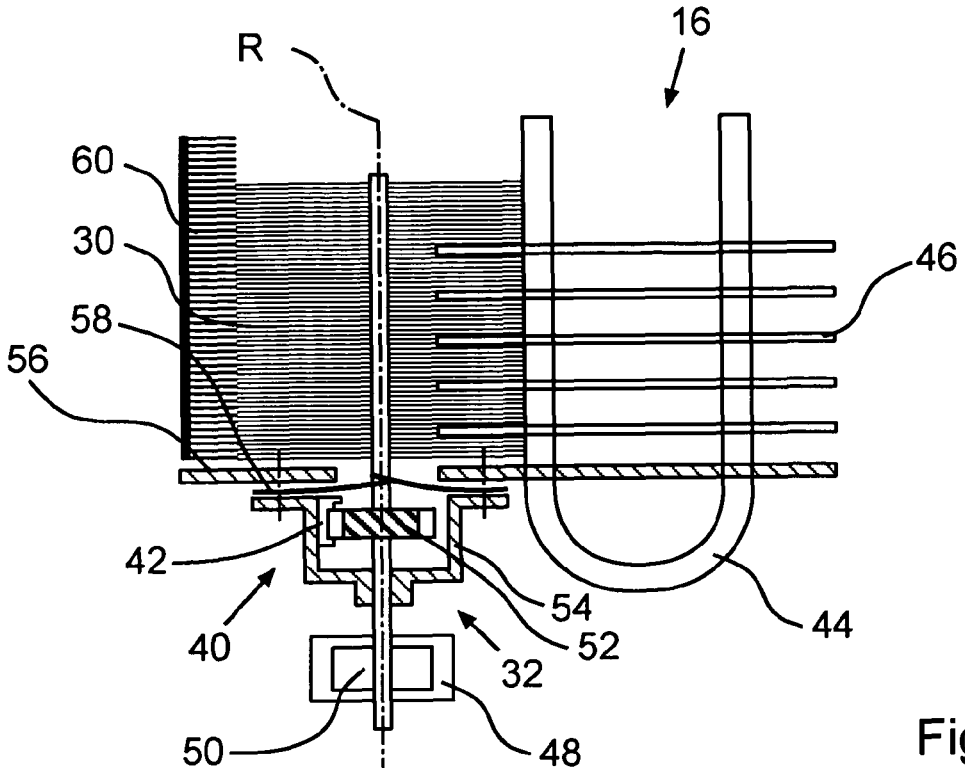
FIG. 3 a schematic side view of a round brush of the brush device driven by means of a motor with intermediate gear, which penetrates at least approximately to a working medium pipe of the working medium evaporator in the heat exchanger; and in FIG. 4 a schematic side view and a schematic overhead view of a heat exchanger arranged within the process air circuit of the household tumble dryer embodied as a condensation device as well as the cleaning device arranged in front of it—seen in the direction of flow of the process air circuit.
Figure 4:
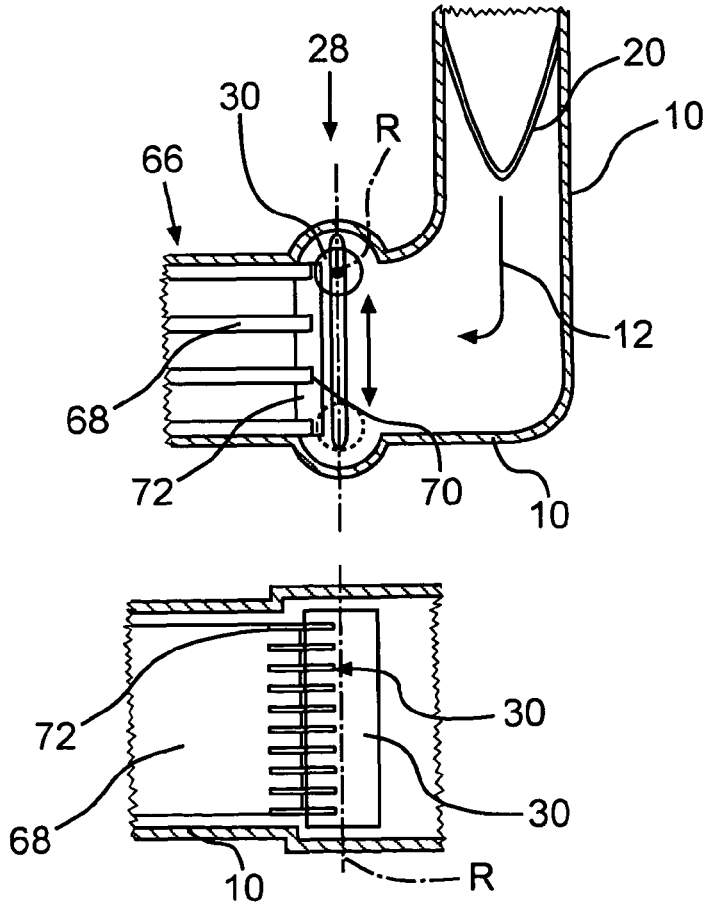

In FIG. 3, in which in a schematic side view the round brush 30 inserted into the front side in the working medium evaporator 16 can be seen, it is also evident that the bristles, tongues or such like can penetrate at least up to the working medium pipes 44 in the working medium evaporator 16. Above these, especially in FIG. 3, can be seen a plurality of fins 46 running in parallel to each other, which are to be cleaned from the front side 34 by means of the round brush 30. It is clear that the deformation of the bristles of the round brush 30 beyond the working medium pipes 44 enables it to penetrate even deeper into the working medium evaporator 16. Provided at the end of the axis of rotation R of round brush 30 is a motor 48 with an intermediate gear, which forms the rotary drive of the round brush 30. Driven via the intermediate gear 50 of the motor 48 is a gear wheel 52 arranged coaxially to the axis of rotation R, which interacts with the rack 42 of the rack drive 40. In other words both the round brush 30 and also the drive mechanism 32 with the rack drive 40 are to be driven via the motor 48 with the intermediate gear 50. Likewise it would also be conceivable for the translational movement of the brush device 28 and the rotation of the round brush 30 to be implemented by separate drives or motors. It can also be seen from FIG. 3 that the rack 42, with which the gear wheel 52 meshes, is arranged within a support bar 54 running along the guiding device 38 (FIG. 2*b*). So that the axis of rotation R can pass through a wall 56 of the channel 10, a slit is provided within this wall which is to be sealed by means of a seal 58. The seal 58 ensures that the rack drive 40 cannot be adversely affected by lint. The cleaning device also comprises the comb 60 visible in FIG. 3, with which lint or similar contamination can be cleaned off the round brush 30. In the present exemplary embodiment the comb 60 engages with the round brush 30 as soon as the latter reaches an end position within the bulges 36.

In the present exemplary embodiment the fins 46 of the working medium evaporator 16 and/or the round brush 30 are also sprayed with the condensate obtained by the working medium evaporator 16. A spray device not shown in the figure is used for this purpose for example, which is supplied with condensate in the area of the outlet line 24. As an alternative it is naturally also conceivable to use another cleaning liquid instead of the condensate. The condensate serves in this case on the one hand to release and transport the lint away from the fins 46, and on the other hand to remove the lint from the round brush 30. The lint or similar contamination removed via the brush device 28 or the round brush 30 from the working medium evaporator 16 can then be pumped away with the condensate via the outlet opening 22 or the outlet line 24. The lint occurring is in turn separated off within the collection tray 26. To enable the lint to be removed especially thoroughly from the working medium evaporator 16 —as is especially evident from FIG. 2*b* —the round brush 30 is preferably operated in a direction of rotation depicted by the arrow 62, in which the bristles engaging with the fins 46 are moved in the same direction as the round brush 30 itself. If the translational direction of movement is changed accordingly —opposite the arrow 64 —, then the direction of rotation of the round brush 30 is also set as a function of this in the opposite direction. The cleaning process is preferably initiated automatically, either towards the end of each drying process of the household tumble dryer, after a specific number of drying processes or as a function of a specific pressure loss of the process air circuit. A sensor 67 is provided for this purpose within the channel 10 (FIG. 1) with which the loss of pressure within the channel 10 conditional on the buildup of lint can be measured.

Finally F*ig*. 4 shows, in a schematic overhead view or in a schematic side view, the channel 10 of the process air circuit, in which however a heat exchanger embodied as the condensation device 66 is provided as an alternative. To this end the channel 10 is shown in section both from above and from the side. The condensation device 66 comprises a plurality of heat exchanger plates 68, through which the warm, moist process air passing from the laundry drum of the household tumble dryer over the lint filter 20 flows and can cool off and condense to cool it down. On the front face side 70 of the condensation device 66 are arranged a plurality of fins 72 running in parallel and in the direction of flow, which jut out forwards beyond the heat exchanger plates 68 and extend backwards by a small longitudinal offset into the heat exchanger plates 68.

It is especially evident from the overhead view that the bristles or similar of the round brush 30 can penetrate at least to the rear end of the fins 72 in the condensation device 66 in order in this way to achieve an even cleaning over the entire depth of the fins 72. So that the deposited lint can be especially easily removed, the fins 72 are to be cooled via the condensation device 66. This means that condensate forms in the area of the fins 72, so that the lint on them can be easily removed. Naturally it is conceivable for the round brush 30 be able to penetrate far enough into the condensation device 66 for the heat exchanger plates 68 to be cleaned as well.

The invention claimed is:

1. A household tumble dryer including a process air circuit; a component within the process air circuit; and a cleaning device operatively disposed within the process air circuit, the cleaning device comprising a rotatable brush device for removal of lint deposits from the component; a linear drive mechanism for driving the brush device along the component; and a rotary drive mechanism for driving the brush device about an axis of rotation, wherein the process air circuit includes at least one bulge to accommodate the brush device, said bulge projecting away from and being wider than a channel of the process air circuit.

2. The dryer according to claim 1 wherein the brush device is configured for movement along at least one of a heat exchanger embodied as a working medium evaporator and a condensation device.

3. The dryer according to claim 2 wherein working elements of the brush device penetrate at least as far as working medium pipes into the working medium evaporator.

4. The dryer according to claim 2 and further comprising a device to use condensate from the working medium evaporator as cleaning fluid.

5. The dryer according to claim 2 wherein heat exchanger is formed with a plurality of fins and the brush device is formed with working elements configured for penetrating at least to a far end of fins in the heat exchanger.

6. The dryer according to claim 5 wherein the fins are configured for cooling the heat exchanger.

7. The dryer according to claim 1 wherein the linear drive mechanism includes a guiding device for moving the brush device in a translational movement.

8. The dryer according to claim 7 wherein the drive mechanism includes a rack drive for movement of the brush device therealong in a translational manner.

9. The dryer according to claim 7 and further comprising a device to adjust the direction of rotation of the brush device as a function of a translational direction of brush device movement.

10. The dryer according to claim 1 and further comprising a motor with an intermediate gear operationally connected to the brush device for driving the brush device rotationally and in translational movement.

11. The dryer according to claim 1 and further comprising a pressure sensor assigned to the cleaning device and operationally disposed within the air circuit, whereby a cleaning process of the cleaning device can be automatically initiated as a function of a pressure sensed by the pressure sensor.

12. The dryer according to claim 1 and further comprising a comb for removing debris from the brush device.

13. The dryer according to claim 1 wherein at least one of the component and the brush device include a cleaning fluid applied thereto.

14. The dryer according to claim 1 wherein the component comprises a heat exchanger arrangement, and the rotatable brush device, driven via the linear drive mechanism, is adapted to remove lint from the heat exchanger arrangement.

15. The dryer according to claim 14 wherein the brush device is configured for movement by the linear drive mechanism at least approximately entirely along a front face side of the heat exchanger arrangement.

16. The dryer according to claim 14 wherein the brush device is arranged in the direction of flow of the process air circuit upstream of the heat exchanger arrangement.

17. The dryer according to claim 14, wherein the rotatable brush is rotatable about an axis and the heat exchanger arrangement includes fins that extend transverse to the axis, such that bristles or tongues of the brush penetrate between the fins.

18. The dryer according to claim 1, wherein the dryer is set to automatically initiate a cleaning process after one or more drying processes.

19. The dryer according to claim 1, wherein the component is an evaporator positioned within the process air circuit.

* * * * *